US007496998B2

(12) United States Patent
Itaya

(10) Patent No.: US 7,496,998 B2
(45) Date of Patent: Mar. 3, 2009

(54) SPRING MANUFACTURING APPARATUS

(75) Inventor: Ichiro Itaya, Tokyo (JP)

(73) Assignee: Kabushiki Kaisha Itaya Seisaku Sho, Tokyo (JP)

( * ) Notice: Subject to any disclaimer, the term of this patent is extended or adjusted under 35 U.S.C. 154(b) by 0 days.

(21) Appl. No.: 11/724,947

(22) Filed: Mar. 16, 2007

(65) Prior Publication Data

US 2007/0234773 A1 Oct. 11, 2007

(30) Foreign Application Priority Data

Apr. 7, 2006 (JP) ..... 2006-106588

(51) Int. Cl.
*B21F 35/00* (2006.01)

(52) U.S. Cl. ..... 29/33 F; 29/896.91; 72/135

(58) Field of Classification Search ..... 29/33 F, 29/896.9, 896.91, 896.92; 72/132, 135, 137, 72/138, 140, 142, 145; 140/139, 140, 149; 267/158, 166
See application file for complete search history.

(56) References Cited

U.S. PATENT DOCUMENTS

| | | | | | |
|---|---|---|---|---|---|
| 5,732,583 | A * | 3/1998 | Itaya | ..... | 72/137 |
| 5,839,312 | A * | 11/1998 | Itaya | ..... | 72/142 |
| 5,875,666 | A * | 3/1999 | Itaya | ..... | 72/140 |
| 5,887,471 | A * | 3/1999 | Itaya | ..... | 72/142 |
| 6,000,265 | A * | 12/1999 | Itaya | ..... | 72/138 |
| 6,142,002 | A * | 11/2000 | Itaya | ..... | 72/137 |
| 6,151,942 | A * | 11/2000 | Itaya | ..... | 72/137 |
| 6,571,591 | B2 * | 6/2003 | Itaya | ..... | 72/137 |
| 6,701,765 | B2 * | 3/2004 | Itaya | ..... | 72/137 |
| 7,143,620 | B2 * | 12/2006 | Itaya | ..... | 72/137 |
| 7,334,445 | B2 * | 2/2008 | Speck | ..... | 72/137 |
| 2007/0234773 | A1 * | 10/2007 | Itaya | ..... | 72/135 |
| 2008/0022742 | A1 * | 1/2008 | Itaya | ..... | 72/135 |

FOREIGN PATENT DOCUMENTS

| | | |
|---|---|---|
| JP | 11-019743 (A) | 1/1999 |
| JP | 4-284934 | 10/1999 |
| JP | 2000-351031 | 12/2000 |
| JP | 2002-239666 | 8/2002 |

OTHER PUBLICATIONS

Japanese Office Action dated Apr. 7, 2008.
Japanese Office Action dated Oct. 20, 2008.

* cited by examiner

*Primary Examiner*—Dana Ross
(74) *Attorney, Agent, or Firm*—Merchant & Gould P.C.

(57) ABSTRACT

A spring manufacturing apparatus comprises a tool support (30, 40, 50) which supports a tool in a way that the tool can be slid toward the spring forming space. A plurality of the tool supports can be arranged in a radial pattern from the spring forming space on the forming table. The apparatus also comprises a driving force transmission unit (70), attached to the tool support on the forming table, which transmits driving force to the tool support for sliding the tool. The tool support includes first and second tool supports for driving a tool by different driving methods. The first tool support (30) comprises a first driving mechanism (32) that transmits driving force of a common driving axis to the tool. The second tool support (40) comprises a second driving mechanism (41) that transmits driving force of the driving axis to the tool.

6 Claims, 11 Drawing Sheets

FIG. 7A
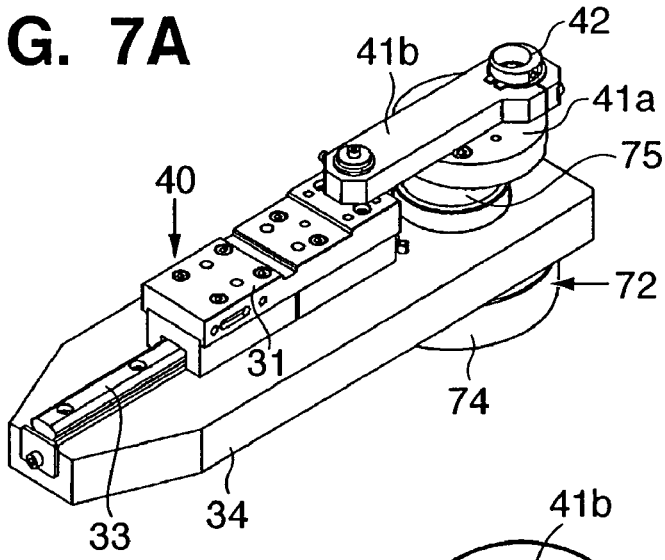
FIG. 7B
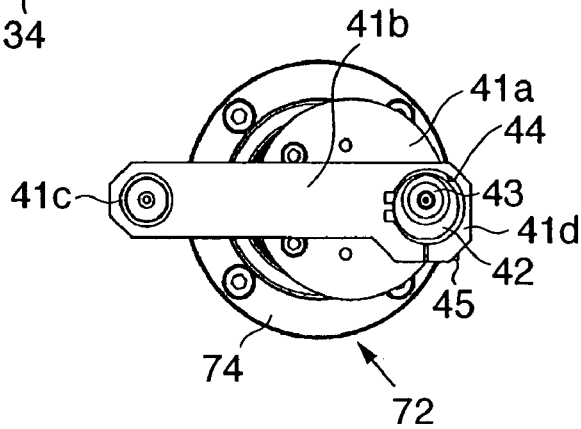
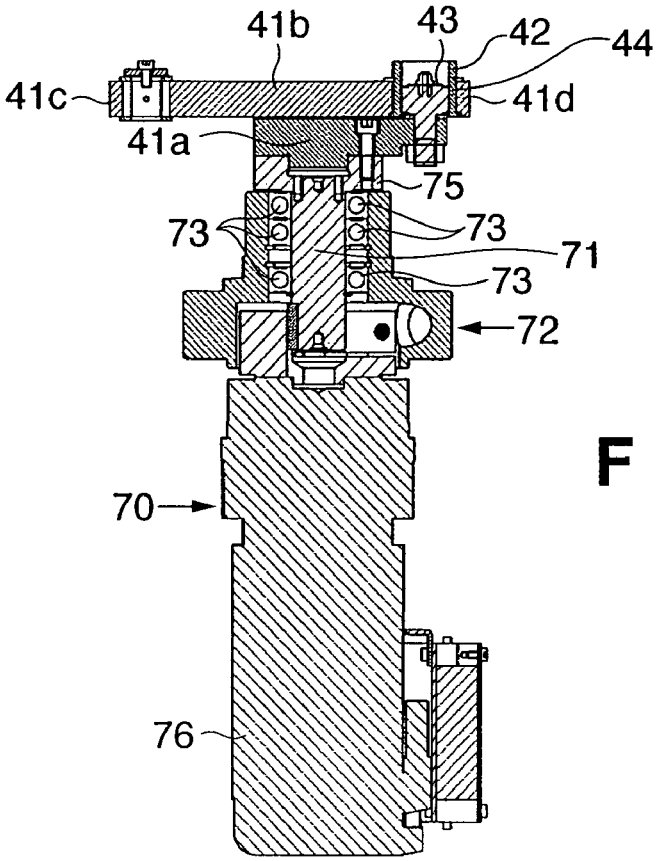
FIG. 7C

SPRING MANUFACTURING APPARATUS

CROSS-REFERENCE TO RELATED APPLICATION

This application is entitled to the benefit of Japanese Patent Application No. 2006-106588, filed Apr. 7, 2006.

BACKGROUND OF THE INVENTION

1. Field of the Invention

The present invention relates to a spring manufacturing apparatus that continuously sends wire, which is to become a spring, to a spring forming space and performs forced bending (bending, winding, or coiling) processing on the wire using a tool, thereby manufacturing a spring.

2. Description of the Related Art

FIG. 11 is a perspective view of a tool unit, shown as conventional tool supporting means, which slidably supports a tool by a ball screw type. FIG. 10 is a plan view of a tool unit, shown as conventional tool supporting means, which slidably supports a tool by a crank type.

As shown in FIG. 11, a conventional slide tool unit 110 slides a slider 111, to which a tool is fixed, by a ball screw mechanism 113 driven by a servomotor 112.

While the tool unit 110 adopting the ball screw type has an advantage in that the amount of tool sending (sliding amount) can be linearly controlled with accuracy, it has a disadvantage in that it is vulnerable to shock received when the tool collides on object.

There is another drawback. Since the tool unit is mounted to the motor, its weight makes the handling difficult.

In comparison, the tool unit adopting the crank type shown in FIG. 10 slidably supports a slider 101 by a disc member 103 driven by a servomotor (not shown) and link members 102*a*, 102*b*, and 102*c* which are eccentrically attached to the disc member 103. The tool unit adopting the crank type is suitable for the processing that requires a large force (wire cutting and bending or the like) as compared with the ball screw type. Also, since a motor is not mounted to the tool unit, the tool unit has the advantage of easy handling. An example is shown in U.S. Pat. No. 6,701,765.

The above-described tool units adopting different driving methods are mounted appropriately to the spring forming table in accordance with the spring shape or the like. Since the motor mounting position differs for each tool unit, if an operator wants to change the driving method of a tool, the operator must exchange the entire tool unit and change the motor mounting position as well.

Such an operation requires not only mere exchange of the tool unit, but also fine adjustment in the mounting position of the tool unit to the forming table, and mounting positions with respect to other tool units and the motor. Such a task is extremely troublesome.

SUMMARY OF THE INVENTION

The present invention has been proposed in view of the above-described problems, and has as its object to realize a spring manufacturing apparatus, which adopts a common form of driving source for tool units employing different driving methods, and which can readily change the driving method to a different method without exchanging the entire tool unit or changing the motor mounting position.

To solve the above-described problems and achieve the object, the present invention provides a spring manufacturing apparatus for manufacturing a spring by executing bending processing with a tool on wire which is sent to a spring forming space on a forming table, comprising: tool supporting means for supporting a tool in a way that the tool can be slid toward the spring forming space, a plurality of the tool supporting means being able to be arranged in a radial pattern from the spring forming space on the forming table; and driving force transmission means, attached to the tool supporting means on the forming table, for transmitting driving force to the tool supporting means for sliding the tool, wherein the tool supporting means includes first and second tool supporting means for driving a tool by different driving methods, the driving force transmission means has a common driving axis that can selectively be attached to the first and second tool supporting means, the first tool supporting means comprises a first driving mechanism that transmits driving force of the driving axis to the tool, and the second tool supporting means comprises a second driving mechanism that transmits driving force of the driving axis to the tool.

More preferably, the first tool supporting means comprises a slider for slidably supporting the tool, and the first driving mechanism comprises: a pinion gear fixed to the driving axis; and a rack that is attached to the slider and engaged with the pinion gear for converting rotation force of the driving axis to linear motion through the pinion gear.

More preferably, the second tool supporting means comprises a slider for slidably supporting the tool, and the second driving mechanism comprises: a disc member fixed to the driving axis; and a link member, whose one end portion is attached to the slider and the other end portion is eccentrically attached to the disc member, for converting rotation force of the driving axis to linear motion through the disc member.

More preferably, the disc member is attached to the link member through an eccentric ring, and an eccentric amount of the link member with respect to the disc member can be adjusted by the eccentric ring.

More preferably, the driving force transmission means is supported by an axis on the forming table such that the driving axis is protruded from one side surface of the forming table on the spring forming space side, and a motor for rotating the driving axis is arranged on the other side surface of the forming table opposite from the spring forming space.

The present invention provides an effect in that a common driving source is provided for tool units employing different driving methods, and that a spring manufacturing apparatus can readily change the driving method to a different method without exchanging the entire tool unit or changing the motor mounting position.

Other objects and advantages besides those discussed above shall be apparent to those skilled in the art from the description of a preferred embodiment of the invention as follows. In the description, reference is made to accompanying drawings, which form a part thereof, and which illustrate an example of the invention. Such example, however, is not exhaustive of the various embodiments of the invention, and therefore reference is made to the claims which follow the description for determining the scope of the invention.

BRIEF DESCRIPTION OF THE DRAWINGS

The accompanying drawings, which are incorporated in and constitute a part of the specification, illustrate embodiments of the invention and, together with the description, serve to explain the principles of the invention.

FIG. 7A is a perspective view of a crank-type slide tool unit;

FIG. 7B is a view showing a rack-and-pinion mechanism of a crank-type slide tool unit;

FIG. 7C is a cross-sectional view of a driving force transmission mechanism of a crank-type slide tool unit;

DESCRIPTION OF THE EMBODIMENTS

A preferred embodiment of the present invention will now be described in detail with reference to the accompanying drawings.

Note that the embodiment described below is provided as an example of realizing the present invention. Therefore, the present invention is applicable to a modified or corrected form of the following embodiment within the scope of the present invention.

[Overall Construction of Spring Manufacturing Apparatus]

Figure 1B:
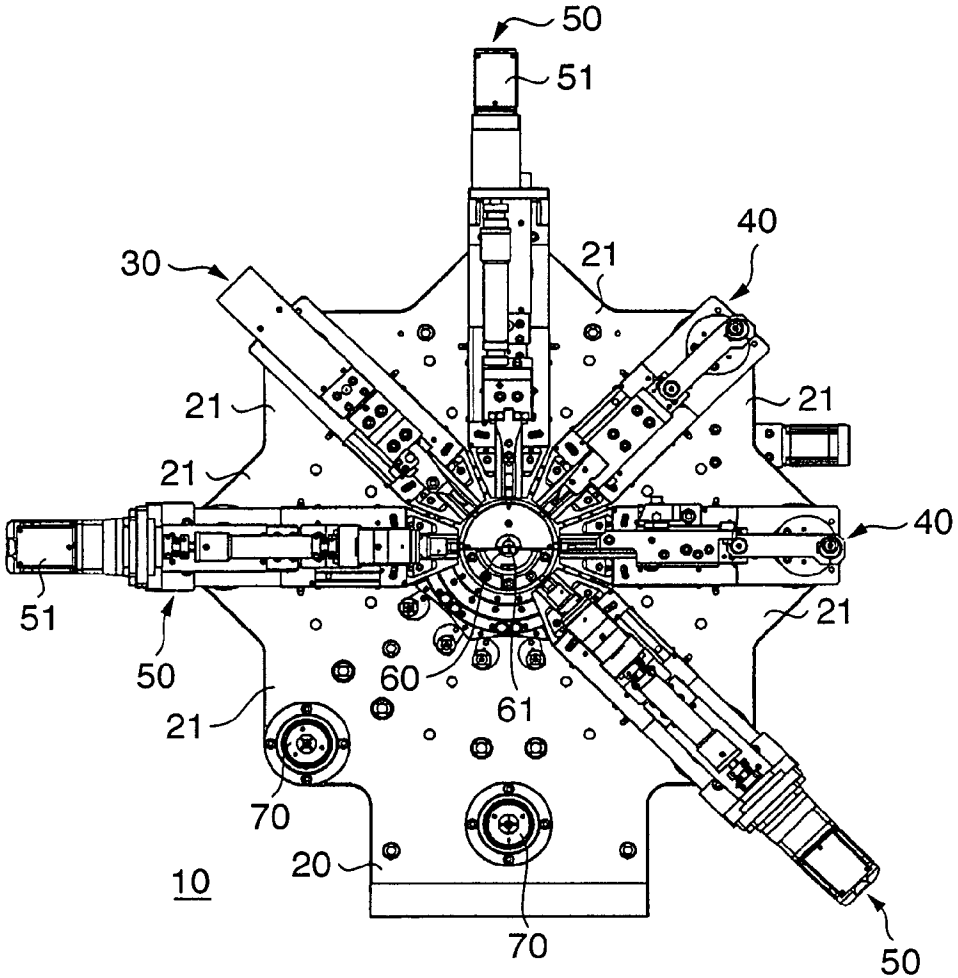
FIG. 1B is a plan view showing a spring forming table portion of a spring manufacturing apparatus according to an embodiment of the present invention.
Figure 1A:
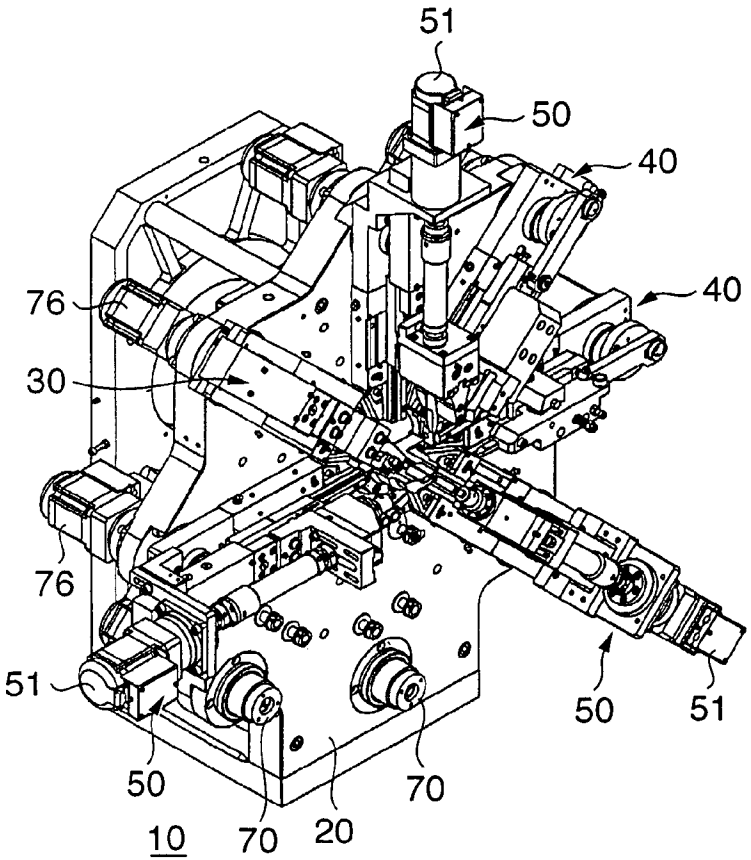
FIG. 1A is a perspective view showing a spring forming table portion of a spring manufacturing apparatus according to an embodiment of the present invention.

FIGS. 1A and 1B are respectively a perspective view and a plan view showing a spring forming table portion of a spring manufacturing apparatus according to the embodiment of the present invention.

As shown in FIGS. 1A and 1B, the spring manufacturing apparatus 10 according to the present embodiment comprises: a forming table 20 provided vertically on top of the base (not shown), a wire feeder (not shown) arranged on the back surface of the forming table 20, and a plurality of tool units 30, 40 and 50 (tool supporting means) which are provided on the front surface of the forming table and are arranged in a radial pattern with the wire axis line in the center.

The forming table 20 has a plurality of triangular tool-unit attaching portions 21 which are extended outwardly in a radial pattern, thus forming a substantially star-like contour. Arranged on the center of the forming table 20 is a wire guide 60. On one side surface of the forming table 20, the plurality of tool units 30, 40 and 50 are attached in a radial pattern, centering around the wire delivering through-hole 61 (wire axis line) of the wire guide 60. The movable space of the tool end portion of each tool and the wire guide 60 delimit the spring forming space. Note that the tool units are arranged in such a way that the intersecting point of the moving locus of respective tool end portions substantially matches the center of the forming table 20, that is, the wire delivering through-hole 61 (wire axis line) of the wire guide 60.

The wire guide 60 is rotatably controlled by a servomotor (not shown) in both forward and backward directions with the wire delivering through-hole 61 in the center.

The tool units 30, 40 and 50 consist of the slide tool units 30 and 40 as well as the rotation tool unit 50. The slide tool units 30 and 40 are capable of moving a tool in a slide motion in the direction of moving toward or away from the spring forming space near the wire delivering through-hole 61 of the wire guide 60. The rotation tool unit 50 is capable of, in addition to the aforementioned sliding motion, rotating a tool on the tool axis. Each of the tools is selectively used to perform forced bending, winding, coiling, or cutting on wire, thereby forming a desired spring shape.

Furthermore, the tool units 30, 40 and 50 consist of the linear-type tool units 30 and 50 adopting the first driving method which slidably supports the tool by a rack-and-pinion mechanism, and the crank-type tool unit 40 adopting the second driving method which slidably supports the tool by a crank mechanism.

Each of the tool units 30, 40 and 50 is detachably provided to the forming table 20 respectively. A total of up to 8 tool units can be attached to the forming table 20.

Figure 4A:
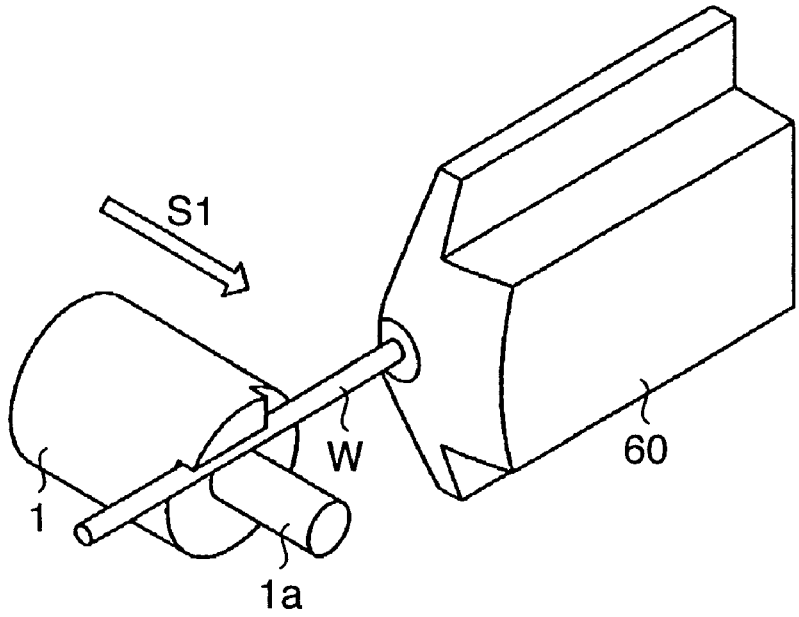
FIGS. 4A and 4B are views showing an example of tool processing suitable for a linear-type tool unit.
Figure 4B:
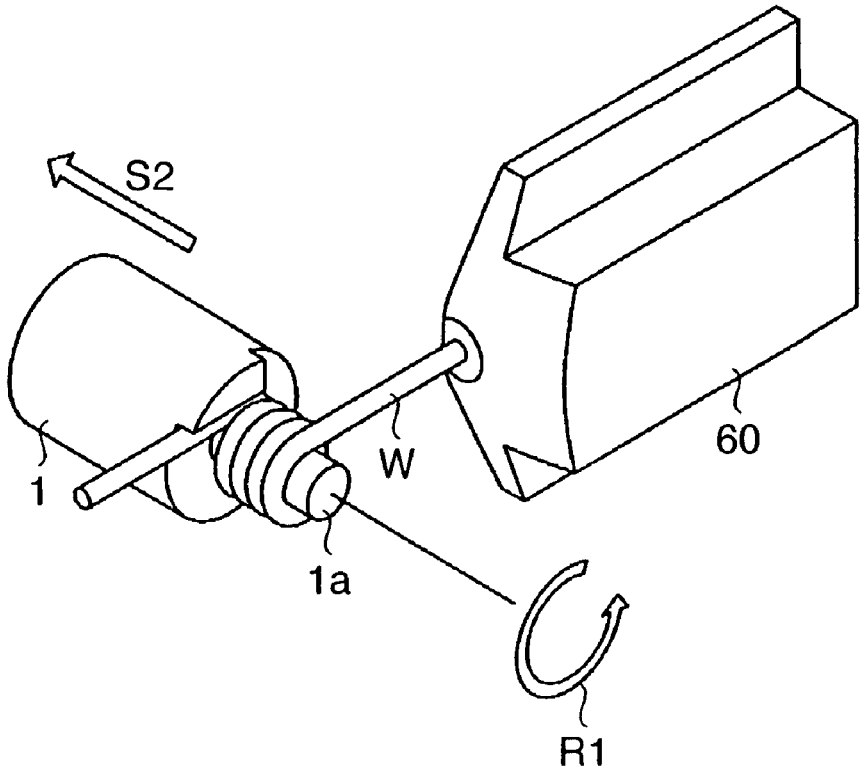
Figure 5A:
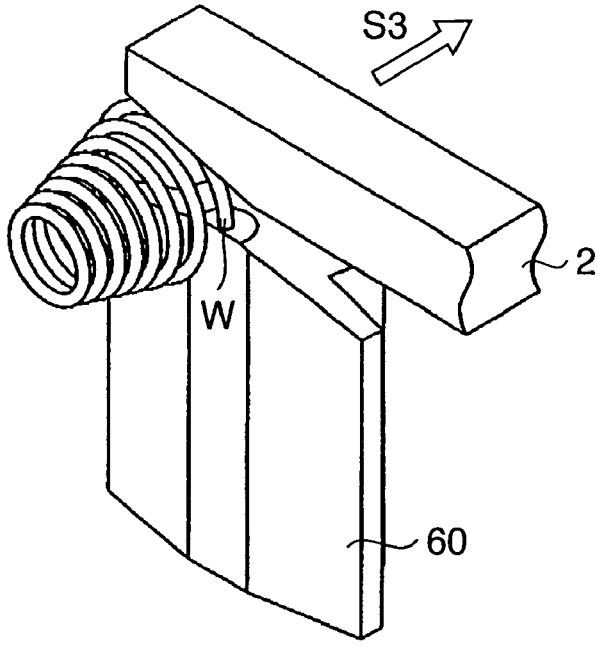
FIGS. 5A to 5C are views showing an example of wire processing suitable for a linear-type tool unit.
Figure 5B:
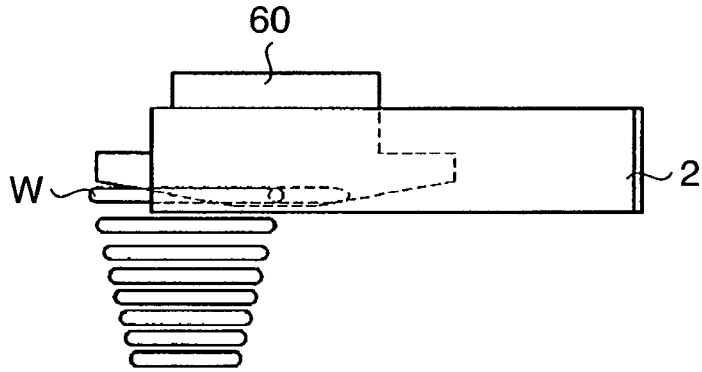
Figure 5C:
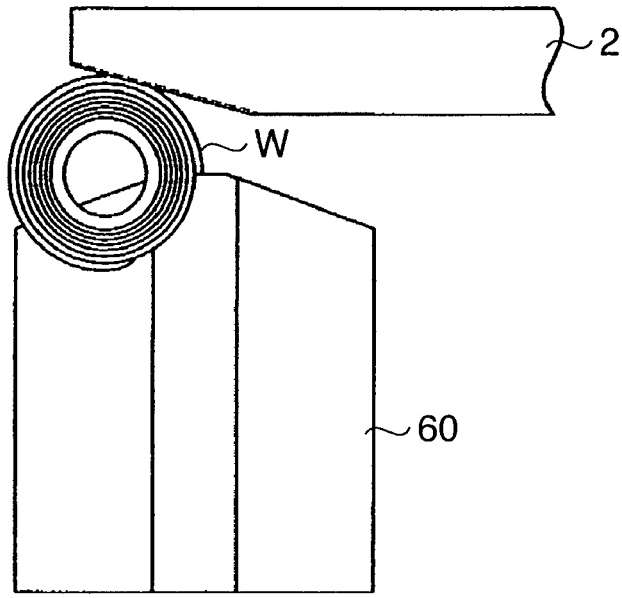

The slide tool units 30 and 40 slidably hold tools (see FIGS. 5A to 5C and 8A to 8B) for forcibly bending, winding, coiling, or cutting (in cooperation with other tools) wire that is sent from the wire delivering through-hole 61 of the wire guide 60 to the spring forming space. The rotation tool unit 50 slidably and rotatably holds a tool (see FIGS. 4A and 4B) for forcibly coiling wire on an axis, which is sent from the wire delivering through-hole 61 of the wire guide 60 to the spring forming space.

The slide motion of the tools held by the slide tool units 30 and 40 as well as the rotation tool unit 50 is realized by a driving force transmission mechanism 70 driven by a servomotor 76, which is arranged on the back surface (the other side surface opposite to the spring forming space) of the forming table 20 corresponding to the respective tool unit attaching positions.

The rotation motion of the tool held by the rotation tool unit 50 is realized by rotating the tool with a servomotor 51 provided on the tool unit 50.

Note that, besides the linear mechanism or crank mechanism which will be described in detail below, the sliding motion of tools can be realized by a driving method employing a cam which converts rotational motion to linear reciprocating motion.

[Tool Unit and Driving Force Transmission Mechanism]

<Linear-Type Slide Tool Unit>

First, the linear-type slide tool unit is described.

Figure 2A:
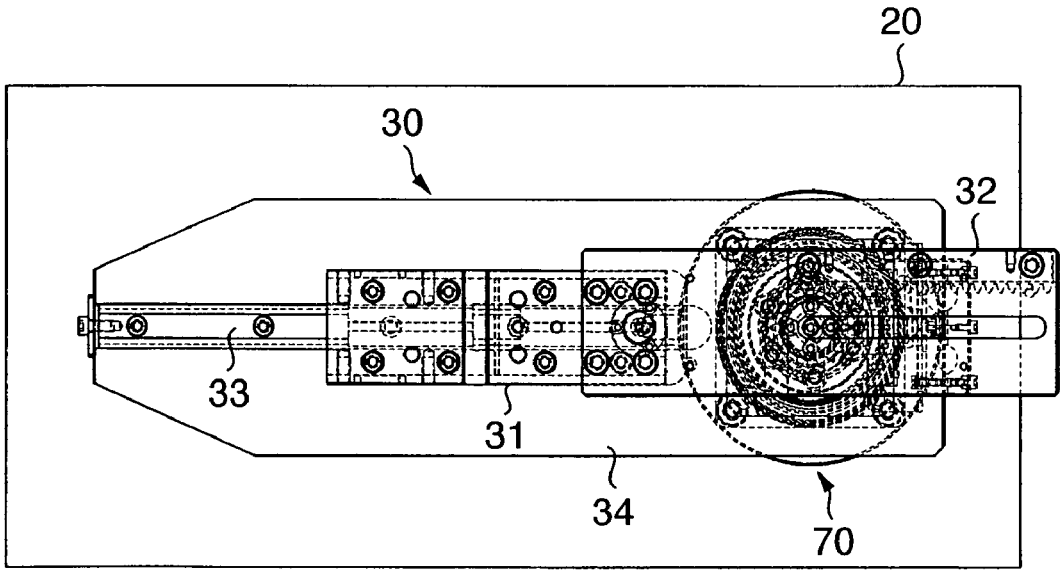
FIG. 2A is a plan view of a linear-type slide tool unit.
Figure 2B:
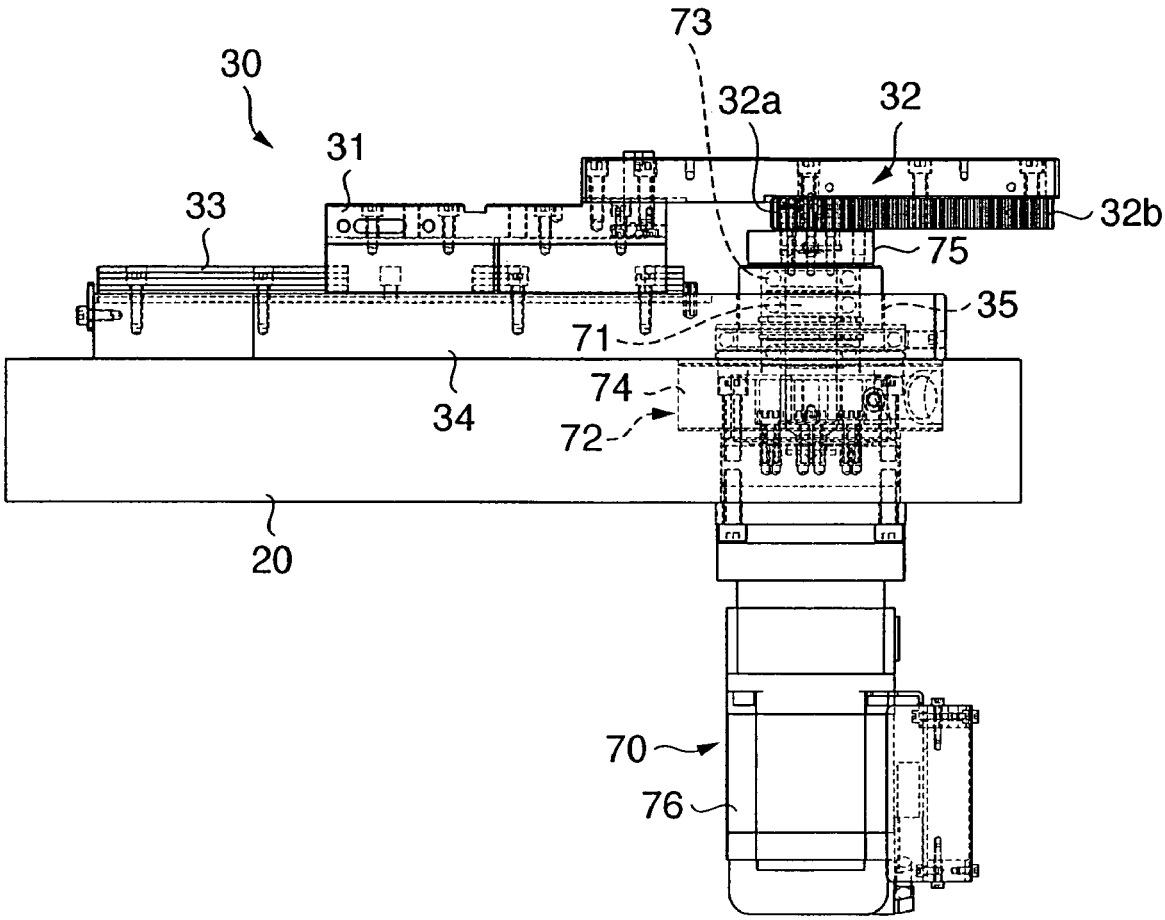
FIG. 2B is a side view of a linear-type slide tool unit.
Figure 3A:
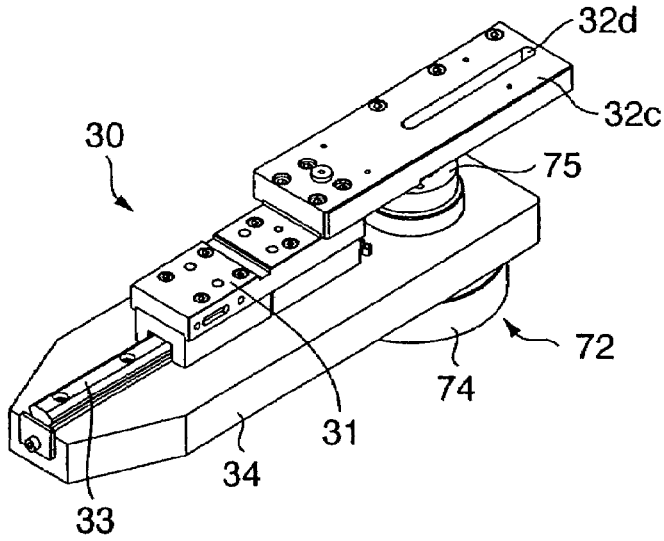
FIG. 3A is a perspective view of a linear-type slide tool unit.
Figure 3B:
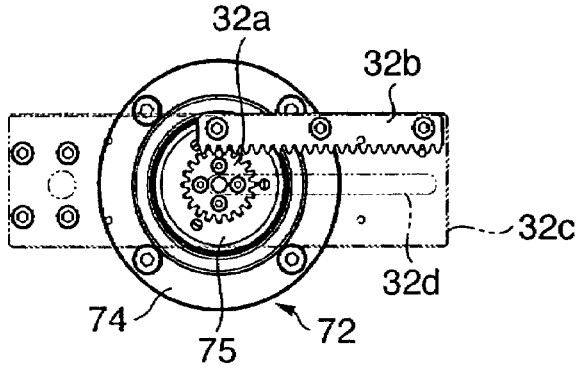
FIG. 3B is a view showing a rack-and-pinion mechanism of a linear-type slide tool unit.
Figure 3C:
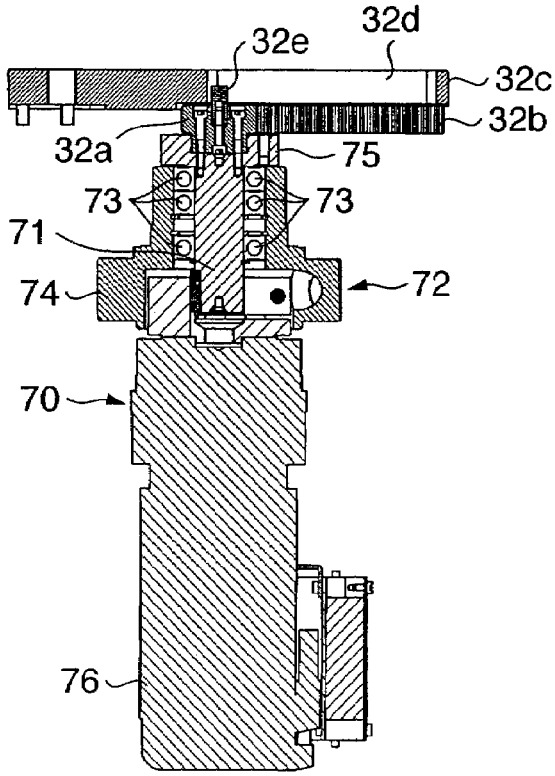
FIG. 3C is a cross-sectional view of a driving force transmission mechanism of a linear-type slide tool unit.

FIGS. 2A and 2B are respectively a plan view and a side view of a linear-type slide tool unit. FIGS. 3A to 3C are respectively a perspective view of a linear-type slide tool unit, a view showing a rack-and-pinion mechanism, and a cross-sectional view of a driving force transmission mechanism.

As shown in FIGS. 2A, 2B and 3A to 3C, the linear-type slide tool unit 30 comprises a slider 31 that slides while holding a tool, a rack-and-pinion mechanism 32 connected to the back end of the slider 31, a slide rail 33 that slidably supports and guides the slider 31 holding the tool, and a slide base 34 that holds the slide rail 33.

The rotation axis 71 of the driving force transmission mechanism 70 is connected to a pinion gear 32*a* of the rack-and-pinion mechanism 32 through a continuous hole 35 formed on the back end of the slide base 34.

The rack-and-pinion mechanism 32 comprises a pinion gear 32*a*, a rack 32*b*, and a cover plate 32*c*. The pinion gear 32*a* is mounted with a screw or the like on the same axis as the joint portion 75 which is formed on one end of the rotation axis 71. By engaging with the pinion gear 32*a*, the rack 32*b* converts rotation of the rotation axis 71 to linear motion parallel to the slide rail 33 through the pinion gear 32*a*. The cover plate 32*c*, holding the rack 32*b*, is connected to the slider 31 at one end. The pinion gear 32*a* is rotated by rotating the rotation axis 71 in both forward and backward directions by the servomotor 76. Through the rack 32*b* and the cover plate 32*c*, the slider 31 performs reciprocal motion parallel to the slide rail 33. On the cover plate 32*c*, an elongated hole 32*d* is formed. A pin 32*e* protruded on the same axis as the pinion gear 32*a* is inserted into the elongated hole 32*d*. The length of the elongated hole 32*d* defines the allowable range of sliding motion of the slider 31. More specifically, by pressing the pin 32*e* of the slider 31 against the end of the elongated hole 32*d*, the hole 32*d* functions as a stopper to prohibit the slider 31 from moving beyond the allowable range.

The driving force transmission mechanism 70 comprises a hollow cylindrical housing 72 which rotatably supports the rotation axis 71 through a bearing 73 such as a ball bearing. The housing 72 is mounted to the forming table 20 through a ring-shaped flange 74 that is formed by expanding the diameter of the peripheral surface on the opposite side of the joint portion 75. The joint portion 75 of the rotation axis 71 is protruded from one side surface of the forming table 20 in the spring forming space. On the other side surface of the forming table 20 opposite from the spring forming space, the servomotor 76 is arranged in correspondence with the housing 72. The end portion of the rotation axis 71 on the housing 72 side is connected to the output axis of the servomotor 76 through a decelerator.

In the above-described structure, by controlling the direction and number of rotation (number of pulses) of the servomotor 76, it is possible to reciprocally move the slider 31 through the pinion gear 32*a* and rack 32*b* while managing the feeding amount of the slider 31.

In the above-described rack-and-pinion mechanism 32, the tool can perform linear and precise motion. Therefore, the mechanism is most suitable for the processing shown in, e.g., FIGS. 4A and 4B. The rotation tool 1 is moved in the direction of the arrow S1 to be engaged with wire W sent out from the wire guide 60, and is returned in the direction of the arrow S2 while rotating the rotation tool 1 in the direction of the arrow R1 to coil the wire W around the coiling axis 1*a*. The mechanism is also most suitable for the processing shown in, e.g., FIGS. 5A to 5C. The wire W is wound by pressing the wire against the coiling tool 2 and wire guide 60 while moving the tool 2 in the direction of the arrow S3, thereby changing the coil diameter (processing of a conical coil having gradually increasing coil diameter).

Note that the above-described rack-and-pinion mechanism 32 is also provided to the rotation tool unit 50 to realize slide motion of the tool.

<Crank-Type Slide Tool Unit>

Next, the crank-type slide tool unit is described. Note in the following description, for the same configuration as that of FIGS. 2A, 2B and 3A to 3C, the same reference numerals are assigned and descriptions thereof are omitted.

Figure 6A:
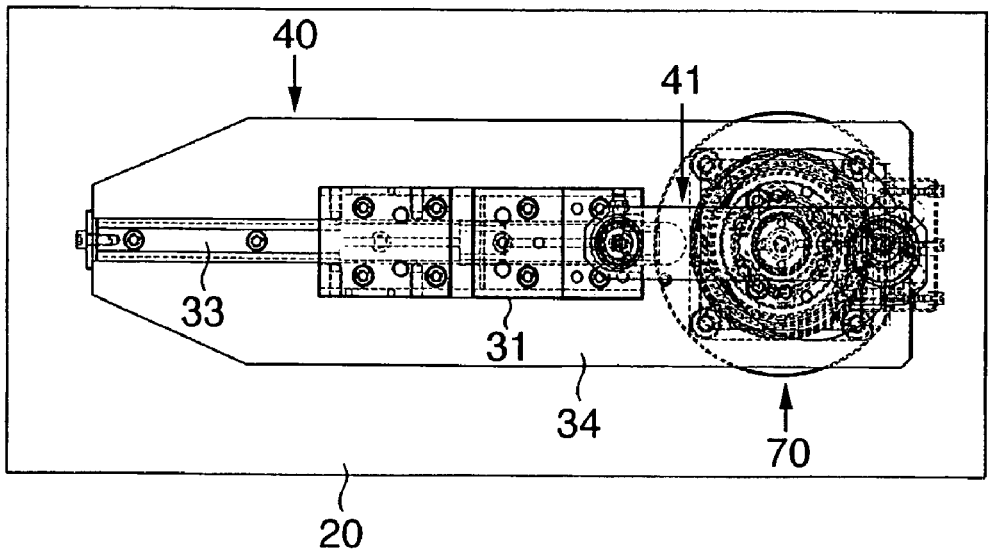
FIG. 6A is a plan view of a crank-type slide tool unit.
Figure 6B:
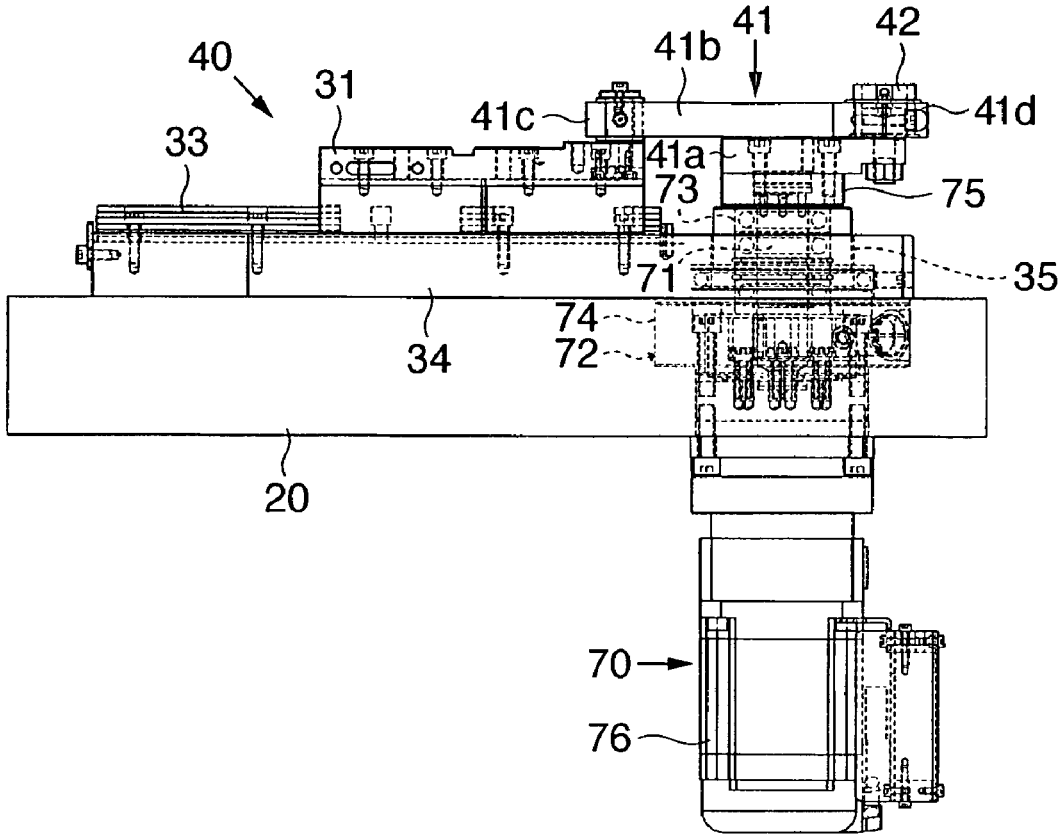
FIG. 6B is a side view of a crank-type slide tool unit.

FIGS. 6A and 6B are respectively a plan view and a side view of a crank-type slide tool unit. FIGS. 7A to 7C are respectively a perspective view of a crank-type slide tool unit, a view showing a rack-and-pinion mechanism, and a cross-sectional view of a driving force transmission mechanism.

As shown in FIGS. 6A, 6B and 7A to 7C, the crank-type slide tool unit 40 comprises common components to those of the linear-type slide tool unit, namely, the slider 31 that slides while holding a tool, the slide rail 33 that slidably supports and guides the slider 31, and the slide base 34 that holds the slide rail 33. Furthermore, the crank-type slide tool unit 40 comprises a crank mechanism 41 attached to the back end of the slider 31, which is a different component from that of the linear-type slide tool unit.

The rotation axis 71 of the driving force transmission mechanism 70 is connected to a disc member 41*a* of the crank mechanism 41 through the continuous hole 35 formed on the back end of the slide base 34.

The crank mechanism 41 comprises a disc member 41*a* and a link member 41*b*. The disc member 41*a* is mounted with a screw or the like on the same axis as the joint portion 75 which is formed on one end of the rotation axis 71. The link member 41*b*, having an end portion 41*c* which is rotatably attached to the slider 31 and the other end portion 41*d* which is rotatably and eccentrically attached to the disc member 41*a*, converts rotation of the rotation axis 71 to linear motion parallel to the slide rail 33 through the disc member 41*a*. The disc member 41*a* is rotated by rotating the rotation axis 71 in both forward and backward directions by the servomotor 76. Through the rotation of the disc member 41*a*, the link member 41*b* which is eccentric with respect to the disc member 41*a* performs reciprocal motion while oscillating, thereby causing the slider 31 to perform reciprocal motion parallel to the slide rail 33.

Note that the driving force transmission mechanism 70 has the same structure as the above-described structure of the linear-type slide tool unit.

In the above-described structure, by controlling the direction and number of rotation of the servomotor 76 with pulse signals or the like, it is possible to reciprocally move the slider 31 through the disc member 41*a* and link member 41*b* while managing the feeding amount of the slider 31.

Figure 8A:
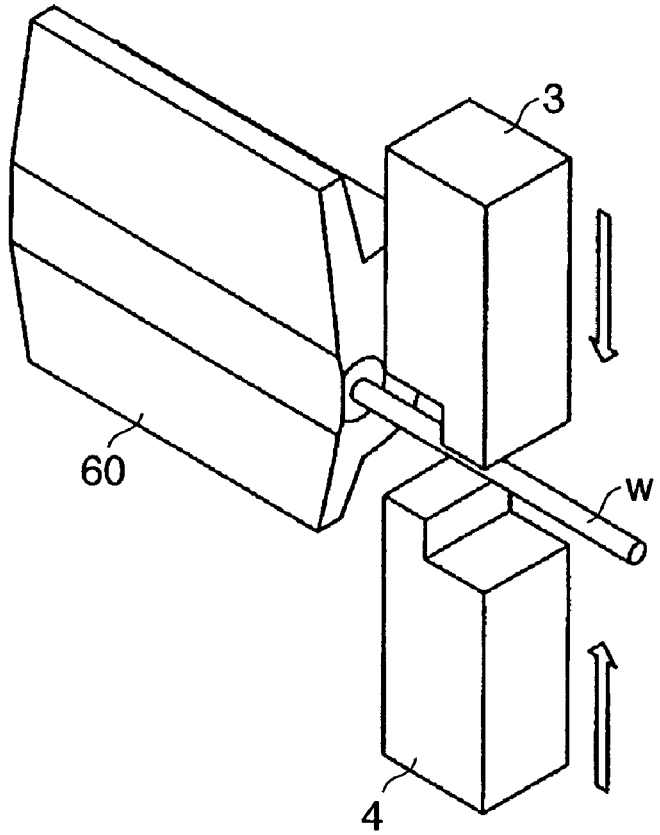
FIGS. 8A and 8B are views showing an example of wire processing suitable for a crank-type slide tool unit.
Figure 8B:
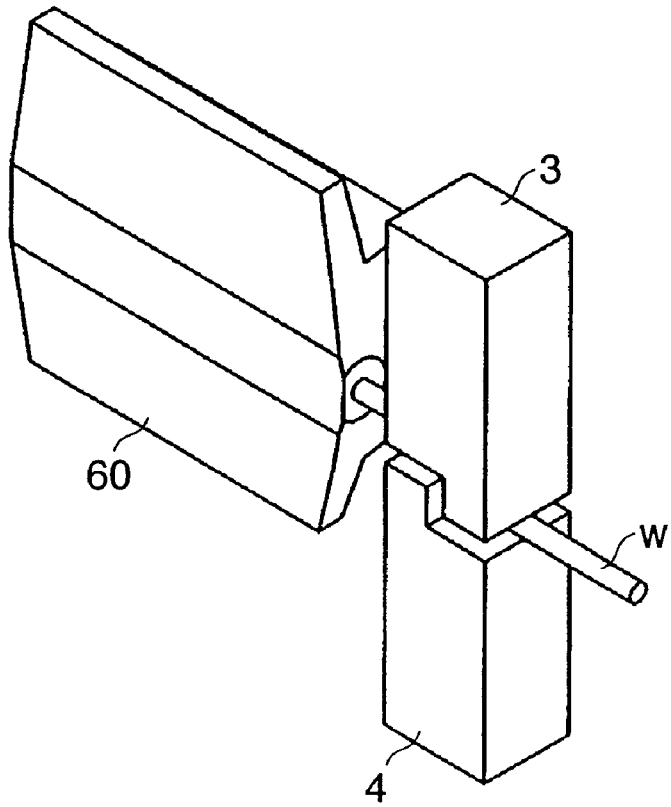

In the above-described crank mechanism 41, the tool can motion with large force. Therefore, the mechanism is most suitable for bending processing of wire W into a crank by clipping the wire with two tools 3 and 4, or cutting processing of wire W, as shown in FIGS. 8A and 8B.

<Fine Adjustment Mechanism of Link Member>

Figure 9A:
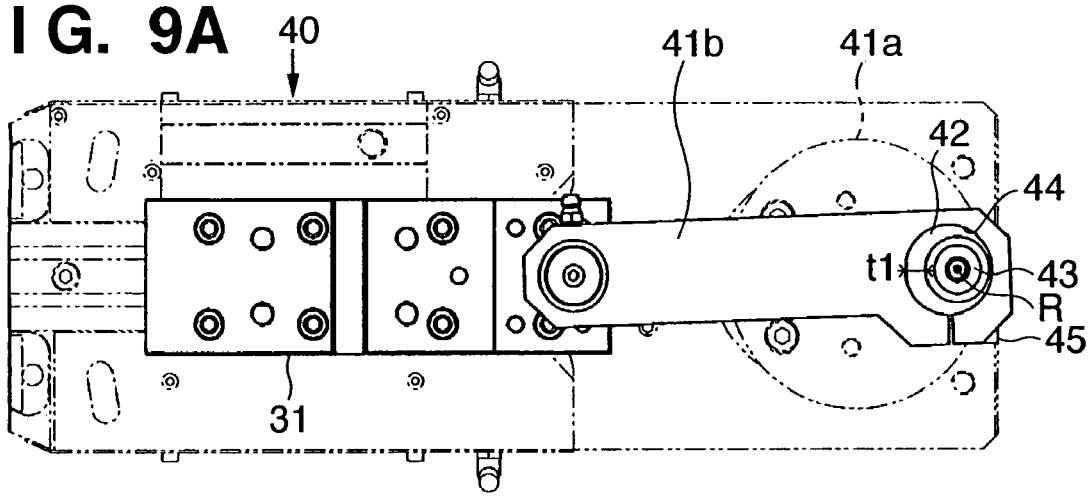
FIGS. 9A to 9C are plan views of a crank-type slide tool unit according to the embodiment, which show a fine adjustment mechanism of an eccentric amount of a link member with respect to a disc member.
Figure 9B:
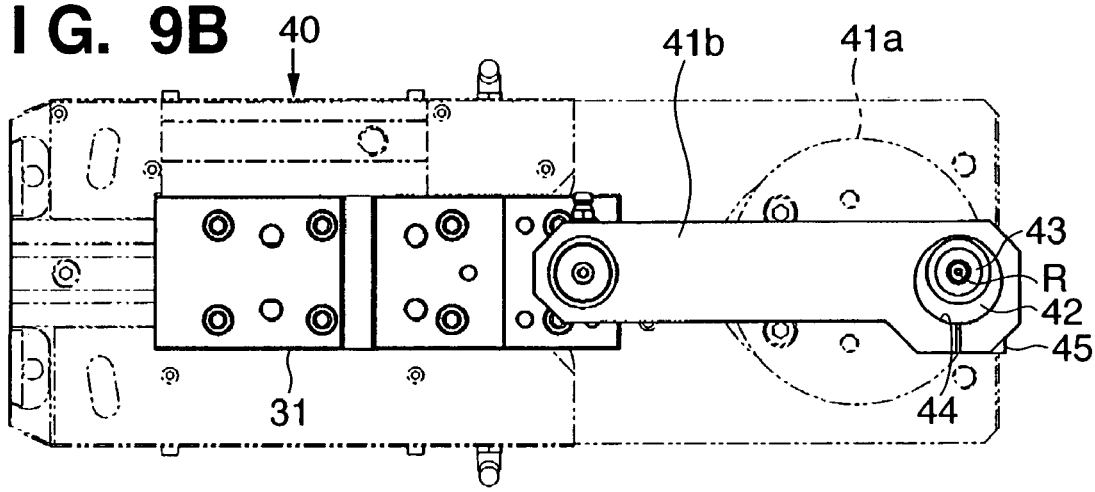
Figure 9C:
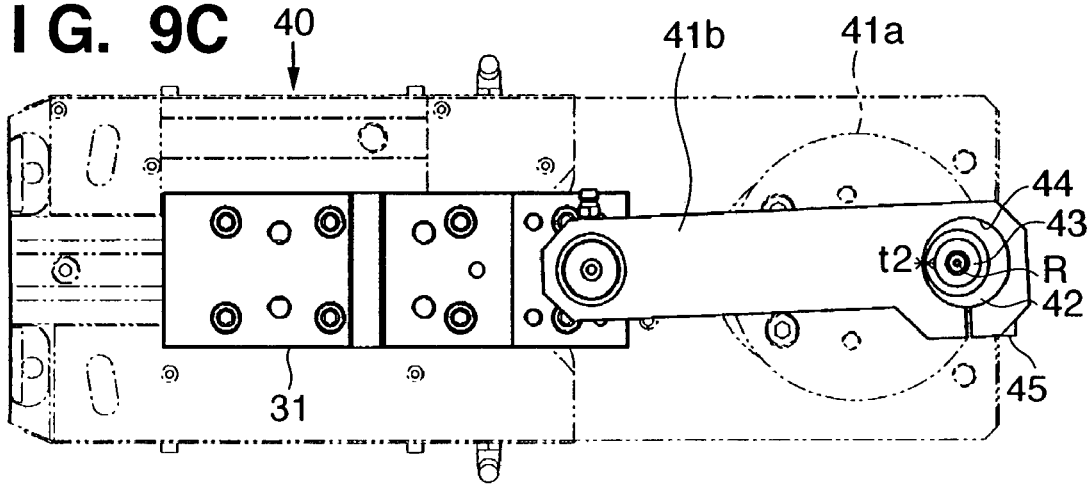

FIGS. 9A to 9C are plan views of a crank-type slide tool unit according to the present embodiment, which show the fine adjustment mechanism of an eccentric amount of the link member with respect to the disc member.

As shown in FIGS. 9A to 9C, at the opening 44 formed on the other end portion 41*d*, the disc member 41*a* is rotatably attached to the other end portion 41*d* of the link member 41*b* with a mounting screw 43 through an eccentric ring 42 having a ring shape. The rotation center R of the eccentric ring 42 is formed eccentrically with respect to the center position of the opening 44 of the other end portion 41*d* of the link member 41*b*. When the link member 41*b* is attached to the disc member 41*a* or when the eccentric amount of the link member 41*b* with respect to the disc member 41*a* is adjusted, an adjustment screw 45 is loosened to rotate the eccentric ring 42 in the direction of the attachment screw 43. As a result, it is possible to make fine adjustments of the eccentric amount (the sliding amount of the slider 31) with respect to the disc member 41*a* within the range from the largest thickness t1 (FIG. 9A) to the smallest thickness t2 (FIG. 9C).

Figure 10:
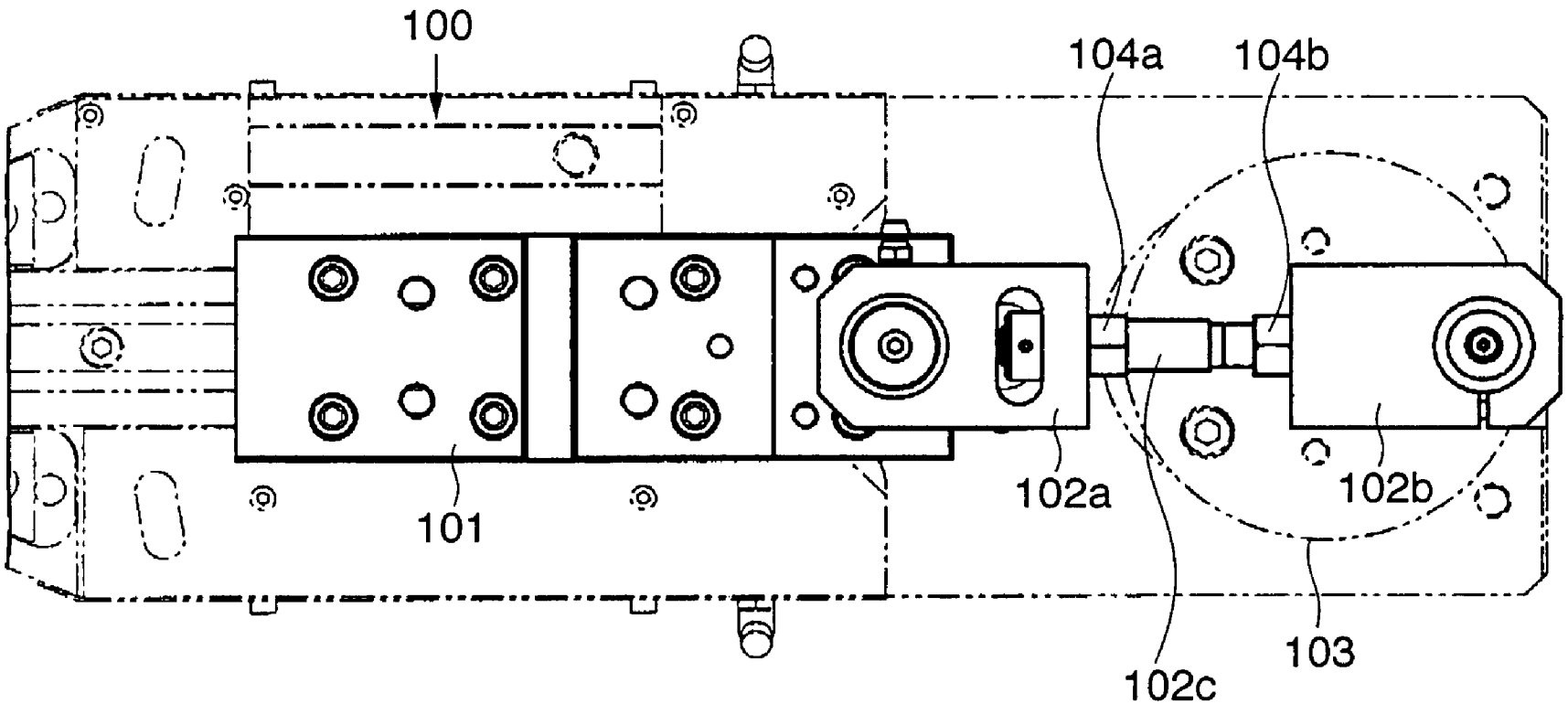
FIG. 10 is a plan view of a conventional crank-type slide tool unit, which shows a fine adjustment mechanism of a link member with respect to a disc member.
Figure 11:
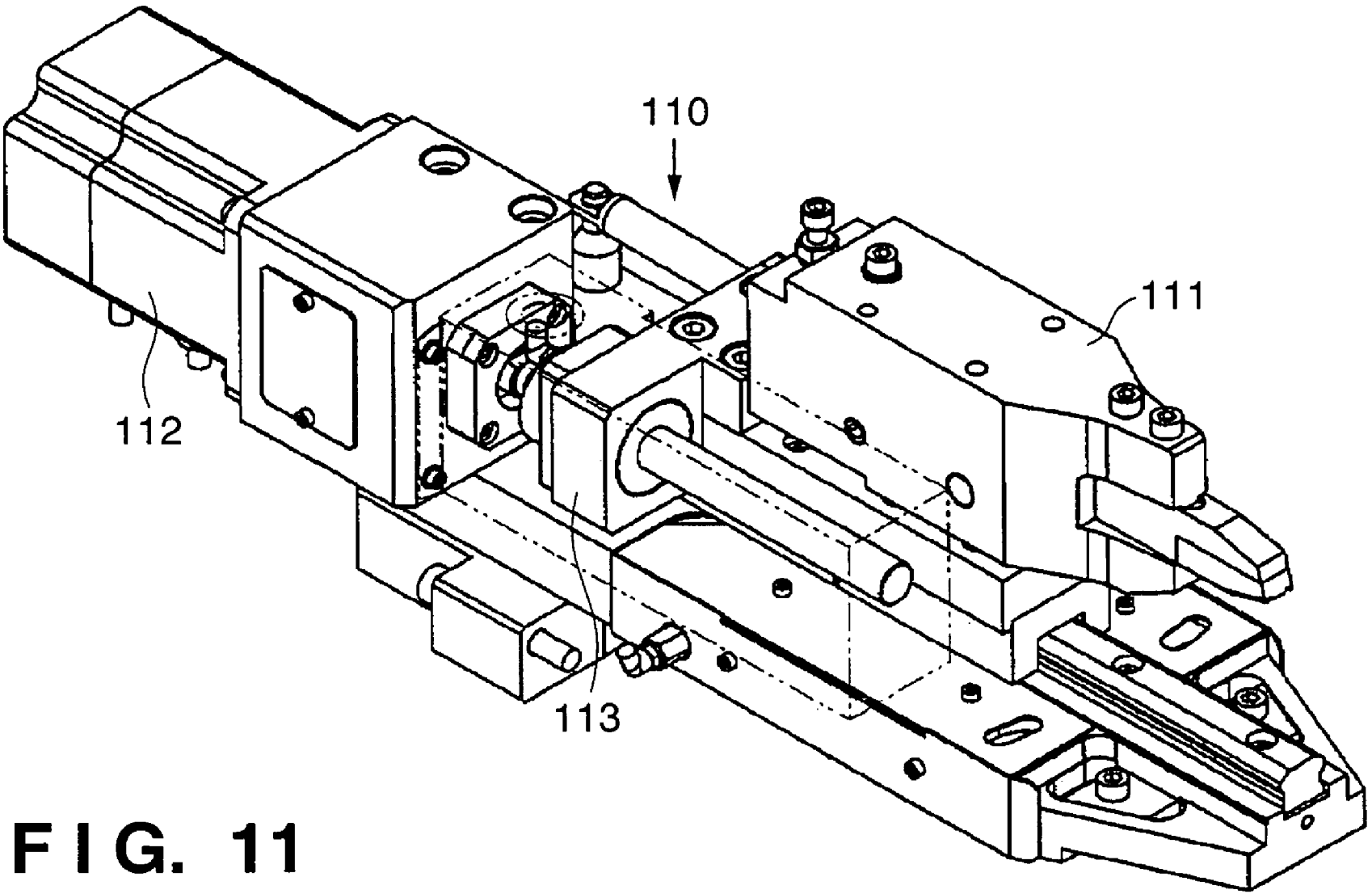
FIG. 11 is a perspective view of a tool unit which slidably supports a tool by a conventional ball screw type.

FIG. 10 is a plan view of a conventional crank-type slide tool unit, which shows the fine adjustment mechanism of the link member with respect to the disc member. The conventional crank-type slide tool unit 100 has a structure in which the link member 102*a* on the slider 101 side is connected to the link member 102*b* on the disc member 103 side with a shaft 102*c*. The separated distance between the two link members 102*a* and 102*b* is finely adjusted by a pair of screws 104*a* and 104*b* provided on both ends of the shaft 102*c*. In comparison, according to the present embodiment, fine adjustment can be realized by simply rotating the eccentric ring 42. Therefore, the adjustment task can be simplified.

[Description of Effects]

Hereinafter, the effects achieved by the driving force transmission mechanism according to the present embodiment are described.

According to the present embodiment, the driving force transmission mechanism 70 comprises the rotation axis 71 that can be shared by and selectively attached to the tool units 30, 40 and 50 adopting different driving methods. When, for instance, the driving method of the tool unit attached to the forming table 20 is to be changed, changing can be realized without detaching the slider 31, the slide base 34, and the driving force transmission mechanism 70 from the forming table 20. Thus, the changing task becomes easy. In other words, a plurality of driving methods can be selected for one tool unit. Furthermore, the driving method changing task can be realized without exchanging the entire tool unit or changing the motor mounting position.

Moreover, it is possible to easily realize fine adjustment of the eccentric amount of the link member 41*b* with respect to the disc member 41*a* in the crank mechanism 41 by using the eccentric ring 42. In other words, it is no longer necessary, as it was conventionally in exchanging the entire tool unit, to make fine adjustments in the mounting position of the tool unit to the forming table or mounting positions with respect to other tool units and the motor.

The present invention is not limited to the above embodiments and various changes and modifications can be made within the spirit and scope of the present invention. Therefore, to apprise the public of the scope of the present invention, the following claims are made.

What is claimed is:

1. A spring manufacturing apparatus for manufacturing a spring by executing bending processing with a tool on wire which is sent to a spring forming space on a forming table, comprising:

a tool supporting unit configured to support a tool in a way that the tool can be slid toward the spring forming space, a plurality of said tool supporting unit being able to be arranged in a radial pattern from the spring forming space on the forming table; and a driving force transmission unit, attached to said tool supporting unit on the forming table, configured to transmit a driving force to said tool supporting unit for sliding the tool, wherein said tool supporting unit includes first and second tool supporting units configured to drive a tool by different driving methods, said driving force transmission unit has a common driving axis that can selectively be attached to the first and second tool supporting units, said first tool supporting unit comprises a first driving mechanism that transmits driving force of the driving axis to the tool by a rack and pinion, and said second tool supporting unit comprises a second driving mechanism that transmits driving force of the driving axis to the tool by a crank.

2. The spring manufacturing apparatus according to claim 1, wherein said first tool supporting unit comprises a slider configured to slidably support the tool, and said first driving mechanism comprises: a pinion gear fixed to the driving axis; and a rack that is attached to the slider and engaged with the pinion gear for converting rotation force of the driving axis to linear motion through the pinion gear.

3. The spring manufacturing apparatus according to claim 1, wherein said second tool supporting unit comprises a slider configured slidably support the tool, and said second driving mechanism comprises: a disc member fixed to the driving axis; and a link member, whose one end portion is attached to the slider and the other end portion is eccentrically attached to the disc member, configured to convert a rotation force of the driving axis to linear motion through the disc member.

4. The spring manufacturing apparatus according to claim 3, wherein the disc member is attached to the link member through an eccentric ring, and an eccentric amount of the link member with respect to the disc member can be adjusted by the eccentric ring.

5. The spring manufacturing apparatus according to claim 1, wherein the driving force transmission unit is supported by an axis on the forming table in a way that the driving axis is protruded from one side surface of the forming table on the spring forming space side, and a motor configured to rotate the driving axis is arranged on the other side surface of the forming table opposite from the spring forming space.

6. A spring manufacturing apparatus for manufacturing a spring by executing bending processing with a tool on wire which is sent to a spring forming space on a forming table, comprising:

a tool supporting unit configured to support a tool in a way that the tool can be slid toward the spring forming space, a plurality of said tool supporting unit being able to be arranged in a radial pattern from the spring forming space on the forming table; and a driving force transmission unit, attached to said tool supporting unit on the forming table, configured to transmit a driving force to said tool supporting unit for sliding the tool, wherein said tool supporting unit includes first and second tool supporting units configured to drive a tool by different driving methods, said driving force transmission unit has a common driving axis that can selectively be attached to the first and second tool supporting units, said first tool supporting unit comprises a slider configured to slidably support the tool, said first tool supporting unit comprises a first driving mechanism that transmits driving force of the driving axis to the tool, said first driving mechanism comprises: a pinion gear fixed to the driving axis; and a rack that is attached to the slider and engaged with the pinion gear for converting rotation force of the driving axis to linear motion through the pinion gear, and said second tool supporting unit comprises a second driving mechanism that transmits driving force of the driving axis to the tool.

* * * * *